US012385714B2

(12) United States Patent
Fisher

(10) Patent No.: US 12,385,714 B2
(45) Date of Patent: Aug. 12, 2025

(54) ARCHERY BOW QUICK DISCONNECT BUSS CABLE WEDGE ASSEMBLY

(71) Applicant: Arizona Archery Enterprises, Inc. (AAE), Prescott Valley, AZ (US)

(72) Inventor: Nicholas Morgan Fisher, Prescott Valley, AZ (US)

(73) Assignee: Arizona Archery Enterprises, Inc. (AAE), Prescott Valley, AZ (US)

( * ) Notice: Subject to any disclaimer, the term of this patent is extended or adjusted under 35 U.S.C. 154(b) by 116 days.

(21) Appl. No.: 18/141,150

(22) Filed: Apr. 28, 2023

(65) Prior Publication Data

US 2024/0361098 A1 Oct. 31, 2024

(51) Int. Cl.
*F41B 5/14* (2006.01)
*F41B 5/10* (2006.01)

(52) U.S. Cl.
CPC ..... *F41B 5/143* (2013.01); *F41B 5/10* (2013.01)

(58) Field of Classification Search
CPC ..... F41B 5/143; F41B 5/10
USPC ..... 124/80, 86, 44.5
See application file for complete search history.

(56) References Cited

U.S. PATENT DOCUMENTS 3,192,662 A * 7/1965 Hoyle ..... A01K 95/00 D22/145
4,453,528 A 6/1984 Eckert
4,664,093 A 5/1987 Nunemaker
4,917,070 A 4/1990 Townsend
5,383,905 A * 1/1995 Golds ..... A61B 17/12013 606/232
5,632,263 A 5/1997 Sartain
6,035,842 A 3/2000 Bradley
6,105,566 A 8/2000 Tiedemann
6,505,619 B2 1/2003 Hulm
6,615,813 B1 9/2003 Troncoso, Jr. et al.
6,739,321 B1 5/2004 Puchlerz
6,782,881 B2 8/2004 Mizek et al.
6,904,900 B2 6/2005 Gallops, Jr.
7,634,990 B1 * 12/2009 Gartland ..... F41B 5/143 124/44.5
9,310,157 B2 4/2016 Jacobs
9,867,365 B1 * 1/2018 Rosenbloom ..... A01K 95/02
9,933,229 B2 4/2018 Coalson et al.
10,345,072 B1 * 7/2019 Webster ..... F41B 5/1411
10,473,420 B1 11/2019 Jones
10,852,097 B2 12/2020 Wilson et al.
11,071,569 B2 * 7/2021 Nguyen ..... A61B 17/8869
2006/0254569 A1 * 11/2006 Chipman ..... F41B 5/10 124/86
2020/0378714 A1 12/2020 Fisher et al.
2022/0113108 A1 4/2022 Munsell
2022/0397370 A1 12/2022 Munsell et al.

* cited by examiner

*Primary Examiner* — John E Simms, Jr.
(74) *Attorney, Agent, or Firm* — Banner & Witcoff, Ltd.

(57) ABSTRACT

A system for use with an archery bow rest is provided including a buss cable wedge configured to engage an archery bow cable, a cable wedge insert configured to engage the buss cable wedge, and a button head screw configured to engage the cable wedge insert, wherein the cable wedge insert and the button head screw are configured to removably secure an arrow rest cable to the archery bow cable.

18 Claims, 8 Drawing Sheets

SECTION A-A

ARCHERY BOW QUICK DISCONNECT BUSS CABLE WEDGE ASSEMBLY

TECHNICAL FIELD

This disclosure relates to the field of archery bow quick release systems for use with arrow rests.

BACKGROUND

Archery compound bows may include a drop away arrow rest. Upon drawing and then releasing an arrow from a compound bow, the arrow rest may drop away from the arrow shaft to improve accuracy and reduce friction on the arrow. A quick disconnect system for a compound bow arrow rest system is desirable to allow arrow rest interchangeability between different compound bows.

SUMMARY

This Summary introduces a selection of concepts relating to this technology in a simplified form as a prelude to the Detailed Description that follows. This Summary is not intended to identify key or essential features.

In some aspects, a system for use with an arrow rest may include a buss cable wedge configured to engage an archery bow cable, a cable wedge insert configured to engage the buss cable wedge, and a button head screw configured to engage the cable wedge insert. In some examples, the cable wedge insert and the button head screw may be configured to removably secure an arrow rest cable to the archery bow cable. In other examples, the buss cable wedge may be generally diamond-shaped. In certain examples, the buss cable wedge may include a groove positioned around an outer perimeter of the buss cable wedge. In yet other examples, the groove may be configured to removably attach to the archery bow cable. In one example, the buss cable wedge may further include a first lip positioned around the outer perimeter, a second lip positioned around the outer perimeter opposite the first lip, and the groove may be positioned or sandwiched between and below the first lip and the second lip. In still other examples, the buss cable wedge may be attached to the archery bow cable by friction fit. In other examples, the buss cable wedge may be a metal, an alloy, or combinations thereof. In one example, the buss cable wedge may be a polymer. In another example, the buss cable wedge may be a carbon fiber material. In another example, an archery bow or a compound bow may include the system disclosed herein.

In other aspects, an archery bow quick disconnect buss cable wedge assembly may include a buss cable wedge configured to attach to an archery bow cable by friction fit, a cable wedge insert configured to engage the buss cable wedge, a button head screw configured to engage the cable wedge insert and the buss cable wedge, and a cable configured to engage an arrow rest and the buss cable wedge. In one example, the cable wedge insert and the button head screw may be configured to removably secure the cable to the archery bow cable. In other examples, the buss cable wedge may be generally diamond-shaped and may include a groove positioned around an outer perimeter of the buss cable wedge. In another example, the buss cable wedge may also include a first lip positioned around the outer perimeter, a second lip positioned around the outer perimeter opposite the first lip, and the groove may be positioned between and below the first lip and the second lip. In still other examples, the buss cable wedge may also include a port configured to engage the cable wedge insert, and the port may include a first curvilinear side, a second curvilinear side opposite the first curvilinear side, a third side, and a fourth side opposite and parallel to the third side. In some examples, the buss cable wedge may include a metal, an alloy, a polymer, a carbon fiber material, or combinations thereof. In another example, an archery bow or a compound bow may include the archery bow quick disconnect buss cable wedge assembly disclosed herein.

In yet another aspect, a kit for use with a compound bow may include a quick disconnect assembly and a set of printed instructions. In some examples the quick disconnect assembly may include a buss cable wedge configured to attach to an archery bow cable by friction fit, a cable wedge insert configured to engage the buss cable wedge, a button head screw configured to engage the cable wedge insert and the buss cable wedge, and a cable configured to engage an arrow rest and the buss cable wedge. In one example, the cable wedge insert and the button head screw are configured to removably secure the cable to the archery bow cable. In another example, each component may be combined into a unitary packaging assembly. In yet another example, the set of printed instructions may be integral with the unitary packaging assembly. In still another example, the set of printed instructions may be printed on the unitary packaging assembly.

These and other features, advantages, and objects of the present disclosure will be further understood and appreciated by those skilled in the art by reference to the following specification, claims, and appended drawings, where various embodiments of the design illustrate how concepts of this disclosure may be used.

BRIEF DESCRIPTION OF THE DRAWINGS

A more complete understanding of features described herein and advantages thereof may be acquired by referring to the following description in consideration of the accompanying drawings, in which like reference numbers indicate like features.

DETAILED DESCRIPTION

In the following description of the various embodiments, reference is made to the accompanying drawings identified above and which form a part hereof, and in which is shown by way of illustration various embodiments in which features described herein may be practiced. It is to be understood that other embodiments may be utilized and structural and functional modifications may be made without departing from the scope described herein. Various features are capable of other embodiments and of being practiced or being carried out in various different ways.

Conventional archery bow arrow rests are fixedly attached to a tether or cable that is fixedly attached to the bow draw string or cable. Such a configuration makes removing the cable attached to the arrow rest from the bow itself extremely difficult and time consuming. With the emergence of quick release arrow rest systems, archers have the capability to swap arrow rests between various bows providing increased flexibility for the archer or hunter. An archer or hunter may have dedicated bows for dedicated purposes. Having a quick release arrow rest equipped with a quick release system for attachment to the bow string and cable would be advantageous. The quick disconnect buss cable wedge assembly for an arrow rest system as disclosed herein provides a novel approach to providing archers and bow hunters desired flexibility.

Figure 1:
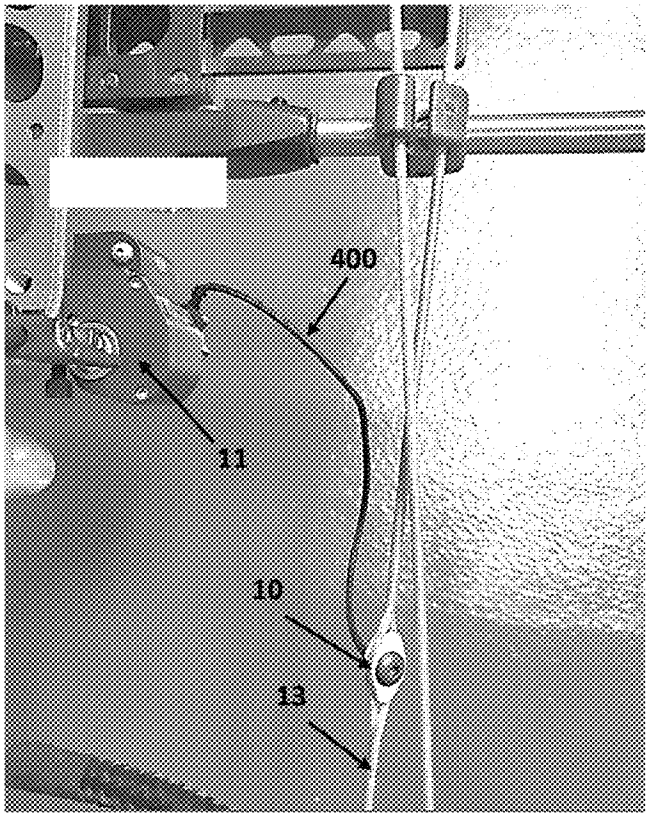
FIG. 1 is an image of a compound bow with a quick disconnect buss cable wedge assembly for an arrow rest system as disclosed herein.
Figure 2:
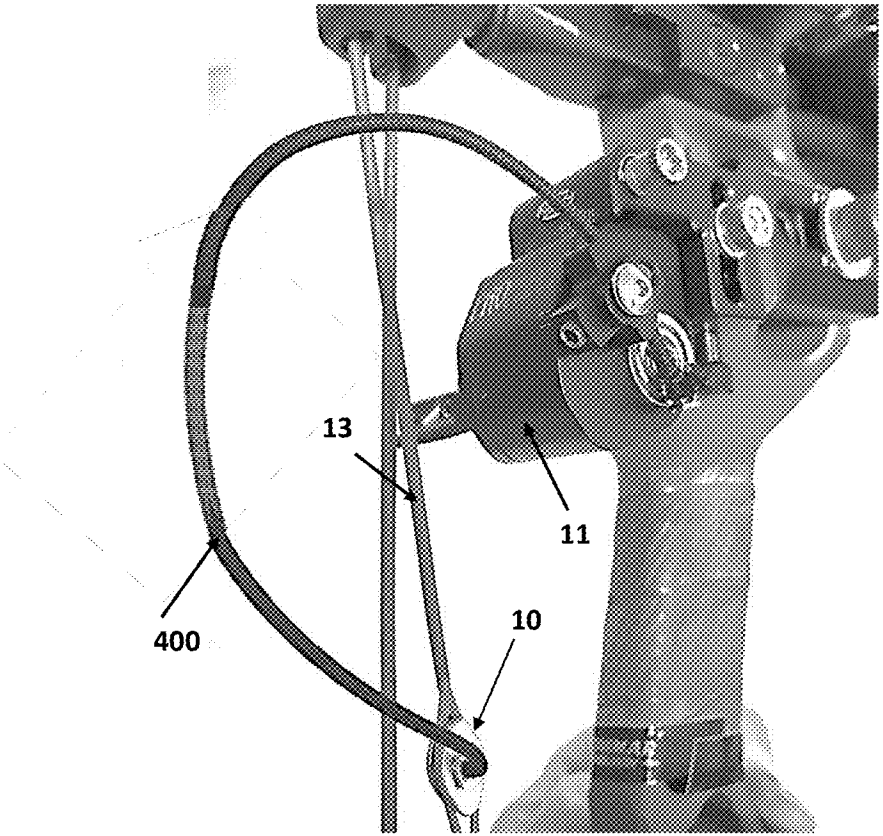
FIG. 2 is an alternative view of the quick disconnect buss cable wedge assembly for an arrow rest system of FIG. 1 as disclosed herein.

FIG. 1 depicts the front side of quick disconnect buss cable wedge assembly 10 for an arrow rest system 11 as disclosed herein. Cable wedge assembly 10 may be configured to attach to bow string or bow cable 13. As shown in FIG. 2, arrow rest cable 12 may be removably attached to a rear portion of the cable wedge assembly 10 and fixedly attached to arrow rest 11.

Figure 3C:
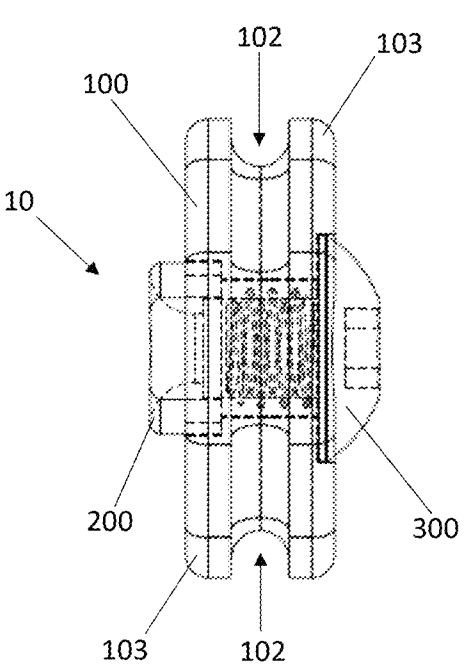
FIGS. 3A-3C are schematics of a quick disconnect buss cable wedge assembly for an arrow rest system as disclosed herein.
Figure 3B:
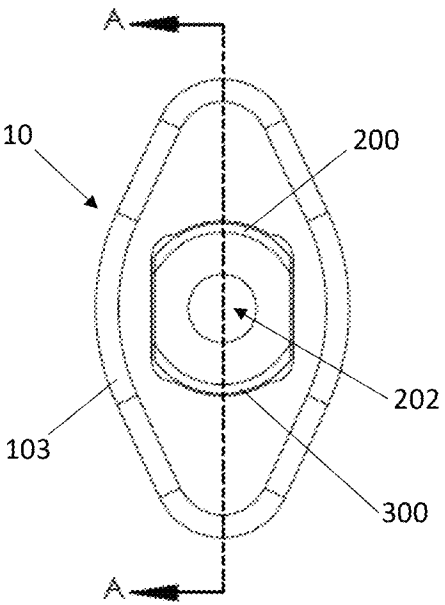
Figure 3A:
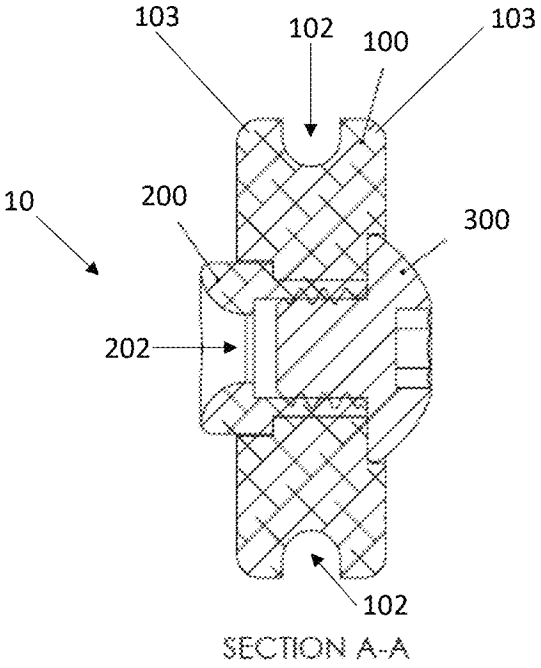

FIGS. 3A-3C depict schematics of a quick disconnect buss cable wedge assembly 10 and related components. As shown in FIG. 3A, assembly 10 may include buss cable wedge 100, cable wedge insert 200, and button head screw 300. Wedge insert 200 may be configured to mate with a center portion of wedge insert 100. Button head screw 300 may be configured to mate with a center portion of buss cable wedge 100 opposite cable wedge insert 200. Button head screw 300 may be configured to engage a female portion of cable wedge insert 200. In some examples, cable wedge insert 200 and button head screw 300 may be removably affixed to each other via threads as shown in FIGS. 3A and 3C. Buss cable wedge insert 200 may include port 202 configured to engage an arrow rest cable. As shown in FIGS. 3A and 3C, buss cable wedge 100 may include groove 102. Groove 102 may be configured to engage a bow string and/or bow cable. Buss cable wedge 100 may include lips 103 positioned above groove 102 and around a perimeter of the outer portion of wedge insert 100. Buss cable wedge 100, wedge insert 200, and button head screw 300 may be formed from a metal, an alloy, a polymer, a carbon fiber material, or combinations thereof.

Figure 4:
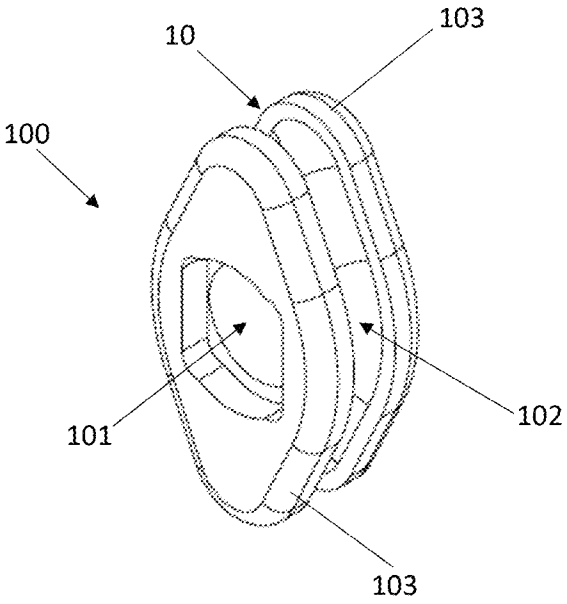
FIG. 4 is a perspective view of a buss cable wedge disclosed herein.
Figure 5C:
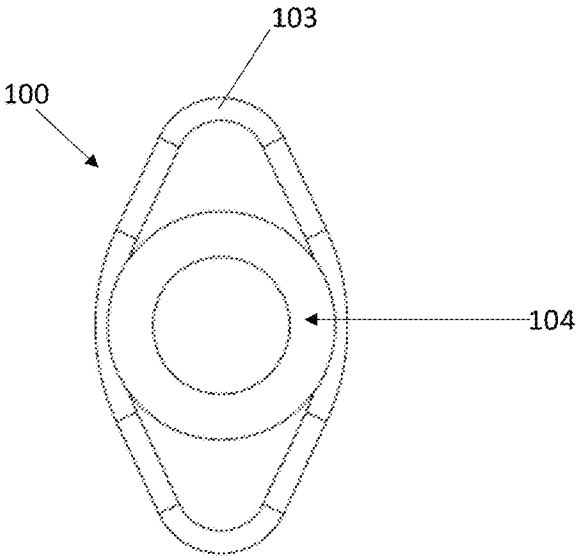
FIGS. 5A-5C are alternative views of the buss cable wedge of FIG. 4 as disclosed herein.
Figure 5B:
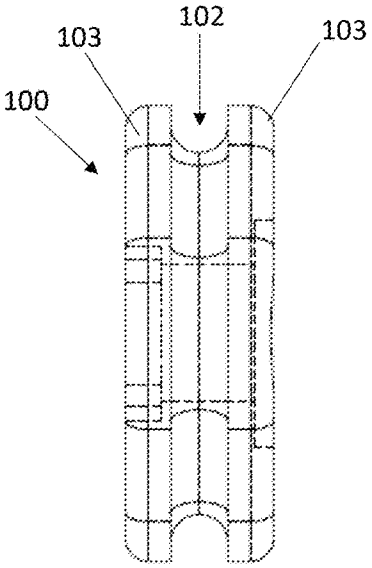
Figure 5A:
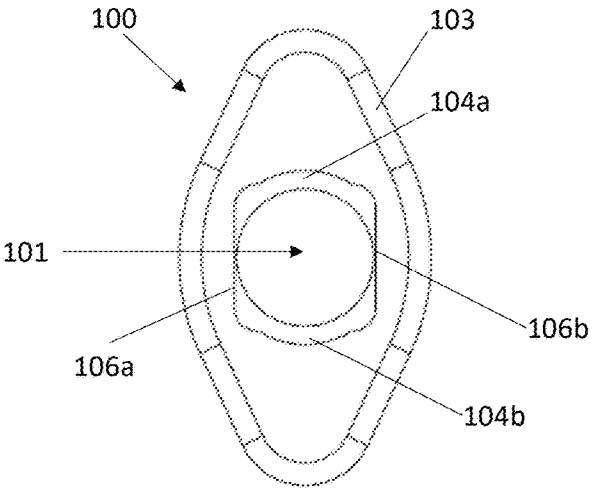
Figure 6:
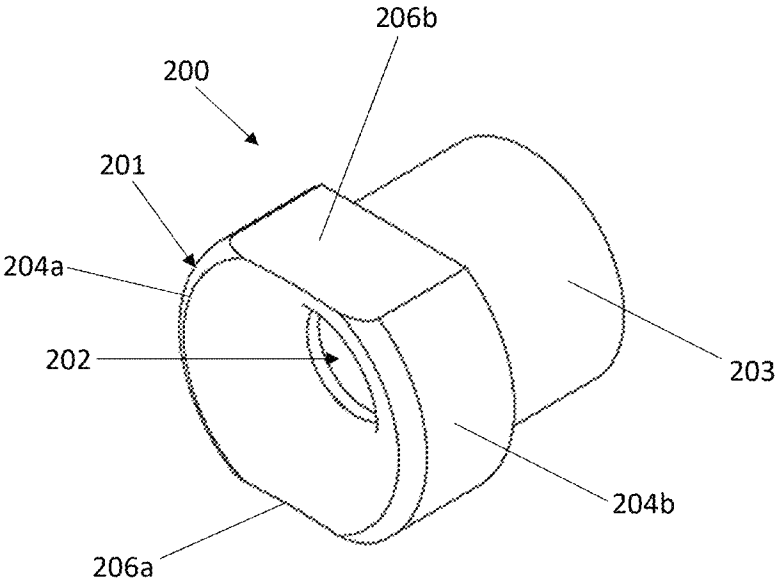
FIG. 6 is a perspective view of a wedge insert as disclosed herein.

As shown in FIG. 4, buss cable wedge 100 may include port 101 configured to engage wedge insert 200. In some examples, as shown in FIG. 5A, port 101 may include first curvilinear side 104*a* positioned opposite second curvilinear side 104*b*. In other examples, buss cable wedge 100 port 101 may also include first side 106*a* and second side 106*b* positioned opposite and parallel to first side 106*a*. Buss cable wedge 100 may be generally diamond shaped or generally shaped as a diamond prism. In some examples, as shown in FIGS. 5A and 5C, buss cable wedge 100 may be generally diamond or diamond prism shaped with curved sides or facets. As shown in FIG. 5B, lips 103 may be positioned opposite each other and around a perimeter of the wedge 100. Lips 103 may be positioned such that lips 103 sandwich groove 102. Groove 102 is configured to engage a bow string or cable and lips 103 provide a barrier or fence to secure buss cable wedge 100 by friction fit into separated strands of the bow string or cable. As shown in FIG. 5C, cable wedge insert 100 may include collar 105 configured to engage button head screw 300. In some examples, collar 105 may include at least two points tangent to lip 103. In other examples, collar 104 may include an inner circumference that may have a circumference that is greater than, less than, or equal to a circumference of port 101. In some examples, collar 104 may include an outer circumference that may have a circumference that is greater than, less than, or equal to a circumference of port 101.

Figure 7C:
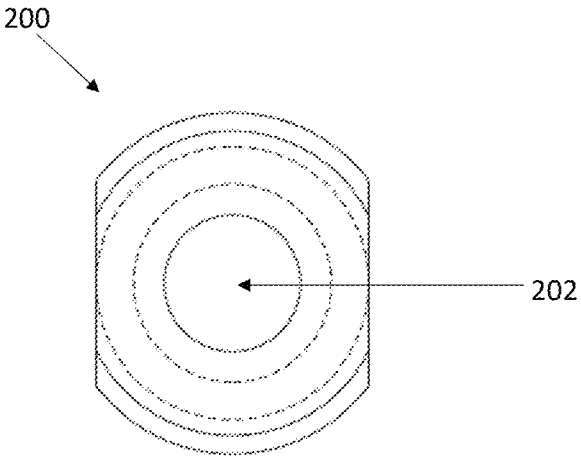
FIGS. 7A-7C are schematic views of the wedge insert of FIG. 6 as disclosed herein.
Figure 7B:
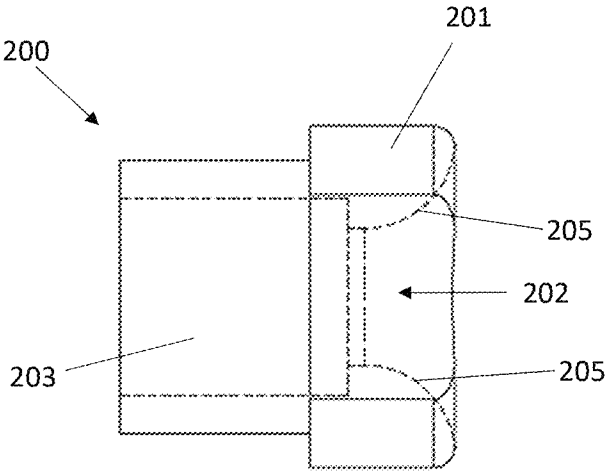
Figure 7A:
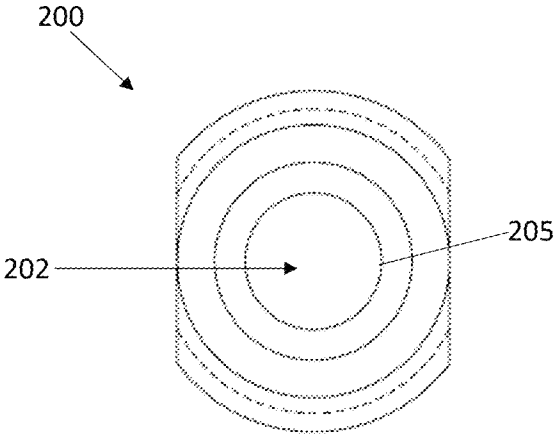

As shown in FIG. 6 and FIGS. 7A-7C, wedge insert 200 may include an outer collar 201, port 202, and stem 203. Outer collar 201 may include first and second curvilinear sides 204*a* and 204*b* configured to engage first and second curvilinear sides 104*a* and 104*b* of buss cable wedge 100. Outer collar 201 may also include first and second sides 206*a* and 206*b* configured to engage first and second sides 106*a* and 106*b* of buss cable wedge 100. As shown in FIGS. 7A and 7B, insert 200 may include an inner contoured surface 205 forming port 202. Port 202 configured to engage an arrow rest cable and contoured surface 205 may assist insertion of an end of the arrow rest cable into port 202 to be secured by button head screw 300. In some examples, surface 205 may be smooth and contoured such that it tapers from a larger outer diameter to a decreasing and smaller inner diameter. In some examples, an inner portion of stem 203 may be threaded to assist engagement of button head screw 300.

Figure 8:
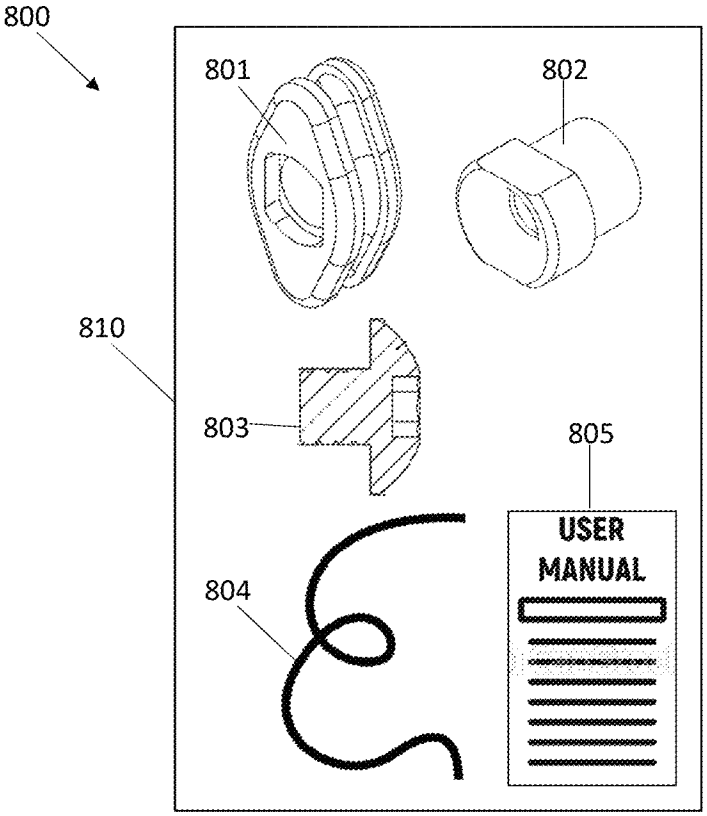
FIG. 8 depicts a kit for a compound bow including a quick disconnect buss cable wedge assembly for an arrow rest system as disclosed herein.

As shown in FIG. 8, kit 800 may include a quick disconnect assembly for use with an archery bow including buss cable wedge 801, cable wedge insert 802, button head screw 803, and cable 804 configured to engage an arrow rest (not shown) and buss cable wedge 801. Kit 800 may also include a set of printed instructions 805. In some examples, kit 800 may include buss cable wedge 801, cable wedge insert 802, button head screw 803, cable 804, and printed instructions 805 in a unitary packaging assembly 810. In other examples, the printed instructions 805 may be printed on or integrated with the unitary packaging assembly 810. In other examples, unitary packaging assembly 810 may include a logo, a brand name, or a trademark.

The foregoing has been presented for purposes of example. The foregoing is not intended to be exhaustive or to limit features to the precise form disclosed. The examples discussed herein were chosen and described in order to explain principles and the nature of various examples and their practical application to enable one skilled in the art to use these and other implementations with various modifications as are suited to the particular use contemplated. The scope of this disclosure encompasses, but is not limited to, any and all combinations, subcombinations, and permutations of structure, operations, and/or other features described herein and in the accompanying drawing figures.

Although examples are described above, features and/or steps of those examples may be combined, divided, omitted, rearranged, revised, and/or augmented in any desired manner. Various alterations, modifications, and improvements will, in view of the foregoing disclosure, readily occur to those skilled in the art. Such alterations, modifications, and improvements are intended to be part of this description, though not expressly stated herein, and are intended to be within the spirit and scope of the disclosure. Accordingly, the foregoing description is by way of example only, and is not limiting.

What is claimed is:

1. A system for use with an arrow rest comprising:

a buss cable wedge configured to engage an archery bow cable, wherein the buss cable wedge comprises a groove positioned around an outer perimeter of the buss cable wedge, and wherein the groove comprises a concave interior surface;

a cable wedge insert configured to engage the buss cable wedge, wherein the cable wedge insert comprises a stem; and a button head screw configured to engage the cable wedge insert, wherein the cable wedge insert and the button head screw are configured to removably secure an arrow rest cable to the archery bow cable.

2. The system of claim 1, wherein the buss cable wedge is generally diamond-shaped.

3. The system of claim 1, wherein the groove is configured to removably attach to the archery bow cable.

4. The system of claim 3, wherein the buss cable wedge further comprises a first lip positioned around the outer perimeter, a second lip positioned around the outer perimeter opposite the first lip, and wherein the groove is positioned between and below the first lip and the second lip.

5. The system of claim 1, wherein the buss cable wedge is attached to the archery bow cable by friction fit.

6. The system of claim 1, wherein the buss cable wedge comprises a metal, an alloy, or combinations thereof.

7. The system of claim 1, wherein the buss cable wedge comprises a polymer.

8. The system of claim 1, wherein the buss cable wedge comprises a carbon fiber material.

9. A compound bow comprising the system of claim 1.

10. An archery bow quick disconnect buss cable wedge assembly comprising:

a buss cable wedge configured to attach to an archery bow cable;

a cable wedge insert comprising a stem and configured to engage the buss cable wedge;

a button head screw configured to engage the cable wedge insert and the buss cable wedge; and a cable configured to engage an arrow rest and the buss cable wedge, wherein the cable wedge insert and the button head screw are configured to removably secure the cable to the archery bow cable.

11. The archery bow quick disconnect buss cable wedge assembly of claim 10, wherein the buss cable wedge is generally diamond-shaped.

12. The archery bow quick disconnect buss cable wedge assembly of claim 11, wherein the buss cable wedge comprises a groove positioned around an outer perimeter of the buss cable wedge.

13. The archery bow quick disconnect buss cable wedge assembly of claim 12, wherein the buss cable wedge further comprises a first lip positioned around the outer perimeter, a second lip positioned around the outer perimeter opposite the first lip, and wherein the groove is positioned between and below the first lip and the second lip.

14. The archery bow quick disconnect buss cable wedge assembly of claim 10, wherein the buss cable wedge further comprises a port configured to engage the cable wedge insert, wherein the port comprises a first curvilinear side, a second curvilinear side opposite the first curvilinear side, a third side, and a fourth side opposite and parallel to the third side.

15. The archery bow quick disconnect buss cable wedge assembly of claim 10, wherein the buss cable wedge comprises a metal, an alloy, a polymer, a carbon fiber material, or combinations thereof.

16. An archery bow comprising the archery bow quick disconnect buss cable wedge assembly of claim 10.

17. A kit for use with a compound bow comprising:

a quick disconnect assembly comprising:

a buss cable wedge configured to attach to an archery bow cable;

a cable wedge insert comprising a stem and configured to engage the buss cable wedge, a button head screw configured to engage the cable wedge insert and the buss cable wedge;

a cable configured to engage an arrow rest and the buss cable wedge, wherein the cable wedge insert and the button head screw are configured to removably secure the cable to the archery bow cable; and a set of printed instructions, wherein each component is combined into a unitary packaging assembly.

18. The kit of claim 17, wherein the set of printed instructions are integral with the unitary packaging assembly.

* * * * *